United States Patent [19]

Lemaire et al.

[11] Patent Number: 4,567,952

[45] Date of Patent: Feb. 4, 1986

[54] PROCESS AND APPARATUS FOR LOCKING AND RELEASING OF A DRILLING SHAFT WITH ESSENTIALLY VERTICAL AXIS

[75] Inventors: Marc Lemaire, Carquefou; Roland Le Roc'h, St-Sebastien sur Loire, both of France

[73] Assignee: Brissonneau et Lotz Marine, Carquefou-Nantes, France

[21] Appl. No.: 489,301

[22] Filed: Apr. 28, 1983

[30] Foreign Application Priority Data

Apr. 30, 1982 [FR] France ..... 82 07539

[51] Int. Cl.[4] ..... E21B 3/00

[52] U.S. Cl. ..... 173/164; 175/85; 166/77.5

[58] Field of Search ..... 173/164, 166; 175/85; 166/77.5

[56] References Cited

U.S. PATENT DOCUMENTS

| | | | |
|---|---|---|---|
| 2,410,589 | 11/1946 | Segelhorst | 166/16 |
| 2,636,241 | 4/1953 | Liljestrand | 24/263 |
| 2,662,737 | 12/1953 | Edelberg | 173/164 |
| 2,814,461 | 11/1957 | Martin | 255/23 |
| 3,158,213 | 11/1964 | O'Neill et al. | 175/85 |
| 3,194,313 | 7/1965 | Fanshawe | 166/77.5 |
| 3,270,389 | 9/1966 | Kingsbury | 24/263 |
| 4,306,339 | 12/1981 | Ward | 24/263 |

FOREIGN PATENT DOCUMENTS

| | | |
|---|---|---|
| 1521103 | 4/1967 | France . |
| 2070233 | 9/1971 | France . |
| 2301683 | 9/1976 | France . |
| 2417003 | 9/1979 | France . |

*Primary Examiner*—James M. Meister
*Assistant Examiner*—Willmon Fridie, Jr.
*Attorney, Agent, or Firm*—Shapiro and Shapiro

[57] ABSTRACT

Apparatus and method for the locking and releasing of a train of drilling shafts having an essentially vertical axis employ wedges adapted to penetrate an opening in a rotation table of a wellhole in order to lock upon a shaft projecting from the opening while another shaft is screwed to or unscrewed from the upper end of the first-mentioned shaft. The wedges have a tapered external shape complementary to the shape of the opening and an internal shape complementary to the external shape of the shafts. Each wedge is individually attached to an associated arm connected to a vertically movable plate by means of an articulation and a jack that applies the wedge to a shaft. The attachment of the wedges to the arms has sufficient freedom to permit the wedges to engage a shaft and center the shaft between the wedges automatically before the wedges are lowered into the opening of the rotation table to lock the engaged shaft therebetween.

4 Claims, 4 Drawing Figures

Figure 1:
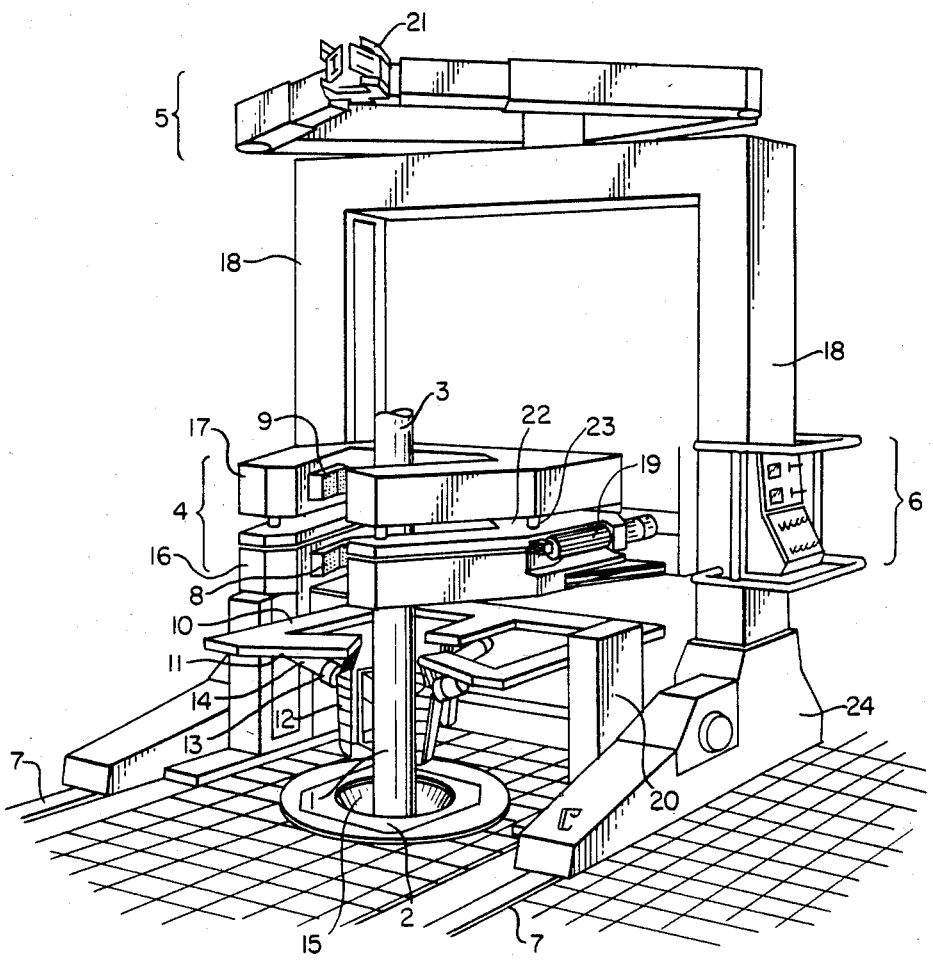

PROCESS AND APPARATUS FOR LOCKING AND RELEASING OF A DRILLING SHAFT WITH ESSENTIALLY VERTICAL AXIS

The present invention concerns the locking and releasing of a train of drilling shafts with essentially vertical axis, so as to permit screwing or unscrewing a shaft at the upper end of the shaft projecting from the rotation table of the wellhole.

Mechanisms are known utilizing wedges having the external form of a truncated cone, which can penetrate into an opening of complementary form arranged for this purpose in the rotation table, and through which passes the shaft train, and internally has the form of a cylindrical section complementary to the external form of the shaft. The French Pat. Nos. 2 301 683 and 2 417 003, for example, describe such mechanisms, one of which displays the disadvantage of being maladapted to being made automatic, and the other of not being capable of being automated.

However, the operation of locking and releasing of shafts must be repeated a large number of times in succession, when it is necessary, for example, to raise several thousand meters of shafts, to change the bit with which the end of the shaft train is equipped, or to perform measurements in the well, or encase of the well, and again an equal number of times to lower all the shafts of the train into the well again.

It is thus obvious that an automation of this operation is highly desirable. The present invention has as its object such an automation.

Summarizing the invention, the process consists first of effecting a pre-gripping against the shaft projecting from the rotation table, by wedges, each of which is fixed to an arm connected to a plate which is mobile in vertical translation, by means of at least one articulation and a jack bearing on the arm, and applying the wedge whose position it controls against the shaft, so as to ensure a strong gripping of the wedges on the shaft, by causing the wedges to penetrate within the opening of complementary form, and thus ensuring locking of the shaft; another shaft is then screwed or unscrewed at the upper end of the shaft thus locked, and then the plate is raised, disengaging the jacks, after having attached the shaft by other means, to prevent its falling into the well.

Preferably, the wedges are three in number, and a passage is provided in the plate to enable placement of the mechanism into position with respect to the shaft train. Preferably, also, the rest position of the plate is the high position, with an elastic medium being stretched during lowering of the platform, in order to ensure its automatic raising, and the releasing of the wedges, at the end of each operating cycle.

The invention of course bears equally upon the mechanism to carry out this process.

The present invention will be better understood, and its other goals, advantages and characteristics will appear more clearly from the reading of the description which follows, of one mode of realization, given by way of non-limitational example, and to which are annexed two plates of drawings.

Figure 2:
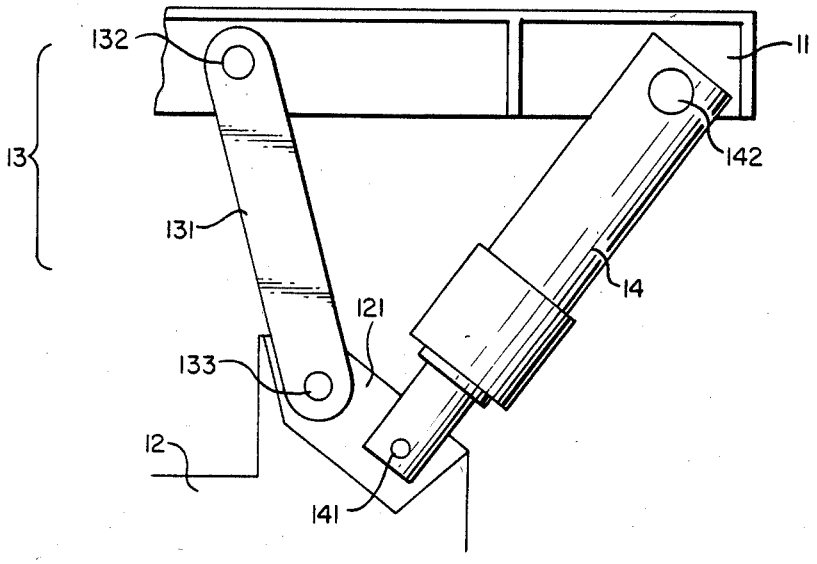
Figure 3:
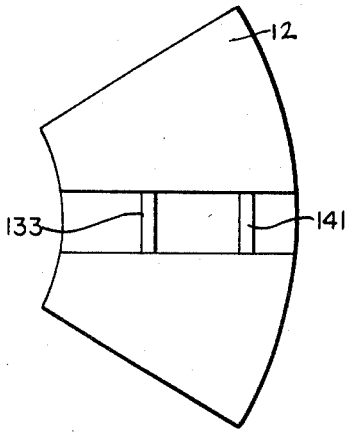
Figure 4:
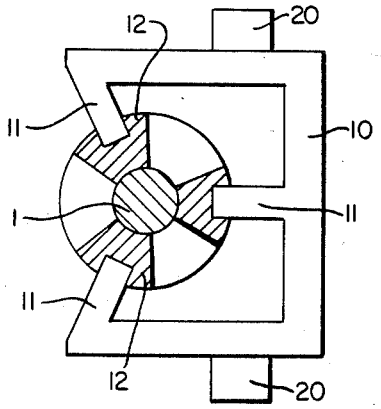

FIG. 1 represents, in perspective, a complete automatic machine, including a locking and releasing mechanism conforming to the invention, and FIGS. 2 to 4 represent schematically the details of realization of the mechanism of FIG. 1.

Referring now to FIG. 1, an automatic machine comprises a number of parts functioning in combination. In particular, it comprises a mechanism permitting locking of the shaft 1 projecting from the well at the level of the rotation table 2; it also comprises a machine 4 to apply the initial torque of unscrewing or final torque of screwing to another shaft 3, represented truncated in FIG. 1, at the upper end of the projecting shaft; it also comprises a machine for rapid screwing or unscrewing, not represented in the figure, a claw 5 for positioning the shafts, and finally, an apparatus for control of the assembly, represented here in the form of a control panel 6. The machine is mounted to move in translation on rails 7 provided for this purpose.

In general fashion, when a shaft train is withdrawn from a well, the shaft sections are disattached from one another, and stored on the bed of the drilling unit; to do this, the shaft train is raised so that the shaft section to be unscrewed can be grasped by the elements of the upper claw of the machine for applying torque, and the lower shaft section can be grasped by the elements of the lower claw 8 of the same machine.

At the same time, since it is necessary to lock the lower shaft 1 in order to prevent the entire remaining shaft train from falling into the well when the upper shaft is unscrewed, first the train is lifted higher, to permit the locking mechanism to grasp the lower shaft 1. This mechanism is constituted by a plate 10 provided with arms 11, to each of which is attached a wedge 12, through the intermediary of a hinge 13 and jack 14, capable of moving vertically. By actuating the jacks 14, there results a clamping of the wedges 12 against the shaft 1, at the same time ensuring auto-centering of the wedges. Then the plate 10 is lowered, for example by gravity under the weight of the shaft train, and the wedges 12 penetrate into the opening 15 of complementary form arranged for this purpose in the rotation table 2, which ensures a tight gripping of the wedges 12 against the shaft 1, the upper end of which furthermore displays a greater external diameter than the rest of the body of the shaft, by way of additional security, and locking of the shaft 1.

When the wedges 12 are within the opening 15 and the shaft 1 is well locked, the machine 4 can operate to apply an initial torque, enabling the upper shaft 3 to undergo a rotation of an angle of about 30° with respect to the lower shaft 1, in order to begin the process of unscrewing.

As is known, a drilling shaft is provided at its lower end with a threaded conical male section, and at its upper end with a complementary threaded conical female section. The machine is here constituted by two claws 16 and 17, positioned one above the other, both of them provided with a set of jaws, 8 and 9 respectively, whose elements are actuated by jacks, not represented in the figure, placed within the claws. These jaws 8 and 9 come respectively to grasp the upper end of the lower shaft 1 and the lower end of the upper shaft 3.

Each set of jaws comprises three elements arranged essentially at the vertices of an equilateral triangle. Two are placed respectively at the end of each branch of the claw, whicl the third, placed at the base of the claw, ensures centering of the shaft, and cooperates with the other two to apply the required torque.

The lower claw 16 is fixed to the frame 18, while the upper claw 17 is mobile in rotation around the axis of the shaft 3 under the action of at least one jack 19 connected at one side to the lower claw 16 and at the other side to the upper claw 17, and, preferably, of two jacks. The two claws are mobile in translation along the axis of the shafts in order to enable correct positioning.

In operation, with the wedges 12 well positioned in the opening 15, the jaws 8 and 9 then come to grasp the shafts, as indicated above. Then the jack 19 imparts a relative movement of rotation of about 30° to the two claws 16 and 17. The assembly then returns to the rest position, the jaws 8 and 9 with the jack 19 behind them having started the unscrewing process by having applied the required torque.

The machine for rapid unscrewing can then operate. This machine has not been represented here, since it is familiar to the man of art.

The claw 5 for positioning of shafts then takes control of the unscrewed shaft 3, to move it to its storage location, with the weight of the shaft being supported, in classical manner, by a cable taken up on the drum of a winch, not represented here.

This cable is then attached to the shaft 1, which is still locked by the wedges 12. Through the action of the winch, the shaft 1 is then raised, to place it in the position occupied by the shaft 3 at the outset of the operation, and to begin the cycle again. As the shaft 1 is raised, the wedges 12 come out of the opening 15. The jacks 14 resume their rest position, which totally frees the wedges with respect to the shaft 1. A system of counterweights and springs, not represented in the figure, but familiar in itself, is arranged in the columns 20 supporting the mobile plate 10, so that at rest, this plate will be in a high position, and the assembly will be ready for a subsequent operating cycle.

It is thus established that the operation of unscrewing can in this way be automated very simply, which permits reducing considerably the personnel of the team in charge of the operation, these personnel furthermore no longer having to exert physical efforts.

The same applies to the inverse operation of screwing. The shaft 3 to be screwed is brought above the shaft 1 projecting from the rotation table 2, by means of the cable supporting it, and the positioning claw 5, whose jaws 21 are provided with a sufficient size to enable them to secure the alignment of the two shafts. By action of the winch, the male end of the upper shaft 3 is introduced into the female section of the lower shaft 1.

The rapid screwing machine than operates under the visual supervision of the operator, by means of an opening 22 in the breadth of the upper claw 17 of the machine for applying the final screwing torque. At the end of this process, the opening 22 is eliminated by placing in rest position jacks, not represented in the figure, acting on fingers 23 to slightly raise a portion of the upper claw 17 during the process of rapid screwing, to permit visual monitoring by the operator. The jaws 8 and 9 grasp respectively the upper end of the lower shaft 1 and the lower end of the upper shaft 3, by means of their various components.

Under the action of the jack 19, a final movement of rotation is imparted to the upper shaft 3, in order to ensure a very firm screwing connection by application of torque. Then the jacks resume successively their rest positions, and the opening 22 in the upper claw 17 appears again.

By means of the cable and the winch, the shaft train is then raised to a height sufficient to enable the wedges 12 to come out of the space 15 in the rotation table 2, and the plate 10 automatically resumes its high position, as indicated previously, with the jacks 14 being in rest position. The operator then lowers the shaft train thus assembled, by a height such that when the wedges 12 are again put in place for the subsequent operating cycle, the upper end of the shaft 3, now in the former place of the shaft 1, will be opposite the jaws 8 of the lower claw 16. The operation can then be repeated with a new upper shaft.

In order to free the space when it is not of use to screw or unscrew shaft sections, the entire machine is mounted on a carriage 24 in the form of a rectangle open on one side, and can be moved on rails 7 provided for this purpose on the drilling platform, on one side and the other of the rotation table 7. Preferably, the columns 18 supporting the machine for applying torque and the machine for rapid screwing or unscrewing are mounted to be movable in rotation by several degrees around an articulation provided in the carriage 24, in order to permit operation of the machine if the axis of the well, and thus of the shafts, is not exactly vertical, but displays a relatively small angle to the vertical, for example less than 5°. Finally, the machine is designed in such a way that it has an open side to enable it to be brought into place, and without its being necessary to close this opening after it is brought into place.

Now the locking mechanism of the lower shaft which constitutes the object of the present invention will be described in greater detail, with reference to FIGS. 2 to 4. As has been seen, this mechanism is constituted by a plate 10 equipped with arms 11, three in number in the example represented, at the end of each of which is attached a wedge 12, by means of at least one articulation 13, and a jack 14.

In FIG. 2 has been represented in cross section the end of one arm 11, and the means of attachment of the wedge 12. As can be observed, the jack 14 is attached on one side to the arm 11, and on the other side to the wedge 12, by means of the articulations 141 and 142.

The articulation 13 here is a double articulation, constituted by a crosspiece 131 attached to the wedge 12 and the arm 11, through the articulations 132 and 133.

Thus, when the jack 14 is actuated, the wedge 12 comes to be placed against the shaft 1, and is capable of auto-centering.

The articulations 133 and 141 are fixed to a shoe 121, itself fixed to the wedge 12, for example by means of a pin, in order to enable non-solidarity of the wedges, with the lower shaft being locked, in order to allow potentially imparting a movement of rotation to the shafts located within the well during the operation of lowering or raising the shafts.

FIG. 3 represents in top view a wedge on which the articulations 133 and 141 can be seen more clearly.

FIG. 4 represents, schematically in top view, the plate 10, with its opening enabling the mechanism to be placed in position above the rotation table 2, with the wedges 12 represented clampled against the shaft 1, here seen in cross-section.

Although only one mode of realization of the invention has been described, it is obvious that any modification introduced by the man of art within the same spirit will not constitute a departure from the framework of the present invention.

We claim:

1. A mechanism for locking and releasing a train of drilling shafts having an essentially vertical axis projecting through an opening of a rotation table of a wellhole, said mechanism comprising wedges each having externally a shape in the form of a section of a truncated cone that is complementary to the shape of said opening and having internally a shape in the form of a cylindrical section that is complementary to the external shape of said shafts, a vertically movable plate, means for supporting said wedges individually on said plate with sufficient freedom to permit the wedges to center a shaft between them automatically and to grip the shaft, said supporting means including, for each wedge, at least one rigid articulation link and an extendable jack, one end of said link being connected to the plate and the opposite end connected the wedge, one end of said jack being connected to the plate and the opposite end connected the wedge for applying the wedge to a shaft, and means for lowering said plate to cause said wedges to enter said opening and lock upon the shaft therebetween.

2. A mechanism according to claim 1, wherein there are three of said wedges and wherein said supporting means includes three arms connected to said plate and on which said wedges are supported, respectively.

3. A mechanism according to claim 1, wherein each jack is connected a wedge through the intermediary of a shoe separate from but attached to the wedge.

4. Apparatus for the locking and releasing of a train of drilling shafts having an essentially vertical axis, comprising, means for holding a shaft projecting from an opening in a rotation table of a wellhole while another shaft is screwed to or unscrewed from the upper end of the first-mentioned shaft, the holding means comprising wedges adapted to enter said opening and having a tapered external shape complementary to the shape of the opening and an internal shape complementary to the external shape of the shafts, each wedge being individually attached to an associated arm of a vertically movable plate by means of a rigid articulation link and an extendable wedge-aplying jack one end of said link being connected to the arm and the opposite end connected to the wedge and one end of said wedge-applying jack connected to the arm and the opposite end to the wedge, the attachment of said wedges to said arms hving sufficient freedom to permit the wedges to engage a shaft and center the shaft between the wedges automatically before the wedges enter said opening.

* * * * *